US010369490B2

(12) United States Patent
Billen

(10) Patent No.: US 10,369,490 B2
(45) Date of Patent: Aug. 6, 2019

(54) MIRRORED BOX

(71) Applicant: Kid Stuff Marketing, Inc., Topeka, KS (US)

(72) Inventor: William D. Billen, Topeka, KS (US)

(73) Assignee: Kid Stuff Marketing, Inc., Topeka, KS (US)

( * ) Notice: Subject to any disclaimer, the term of this patent is extended or adjusted under 35 U.S.C. 154(b) by 0 days.

(21) Appl. No.: 15/830,259

(22) Filed: Dec. 4, 2017

(65) Prior Publication Data

US 2019/0168130 A1 Jun. 6, 2019

(51) Int. Cl.

| | |
|---|---|
| ***A63J 21/00*** | (2006.01) |
| ***B65D 5/42*** | (2006.01) |
| ***B65D 5/02*** | (2006.01) |
| *G02B 27/00* | (2006.01) |

(52) U.S. Cl.

CPC ..... *A63J 21/00* (2013.01); *B65D 5/0254* (2013.01); *B65D 5/425* (2013.01)

(58) Field of Classification Search

CPC ..... G02B 27/00; G02B 27/08; G02B 27/24; G02B 27/2235; G02B 27/2292; G09F 19/16; A63H 33/22; A63J 99/00; A63J 21/00

USPC ..... 472/59, 63, 74, 75, 81; 446/147–148

See application file for complete search history.

(56) References Cited

U.S. PATENT DOCUMENTS

| | | | | |
|---|---|---|---|---|
| 2,112,062 | A | 3/1938 | Berger | |
| 4,023,794 | A | 5/1977 | Adams | |
| 4,720,184 | A * | 1/1988 | Watson | A47G 1/02 359/856 |
| 4,898,560 | A * | 2/1990 | Moscovich | A63F 9/0613 359/850 |
| 4,960,274 | A | 10/1990 | Boles | |
| 5,603,558 | A | 2/1997 | Zimmer | |
| 6,899,223 | B2 | 5/2005 | Carney et al. | |
| 7,389,868 | B2 | 6/2008 | Lewand et al. | |
| 7,883,342 | B2 * | 2/2011 | Yoshida | H01R 13/5227 439/205 |
| 2015/0193084 | A1 * | 7/2015 | Juni | G03B 21/00 345/175 |

* cited by examiner

*Primary Examiner* — Kien T Nguyen

(74) *Attorney, Agent, or Firm* — Erickson Kernell IP, LLC

(57) ABSTRACT

A foldable box with a hidden compartment formed from a sheet of semi-rigid material is presented. The box includes a bottom panel, a left inner side panel, a right inner side panel, a mirror panel, a front panel, a top panel, a left outer side panel, a right outer side panel, a back panel and an inner backer panel. The panels are connected to various other panels which when folded present a box with a compartment that is divided into a front compartment and a hidden compartment. The front compartment is viewable through an opening in the front of the box. A mirrored panel viewable through the opening creates an illusion of depth. An object placed in the hidden compartment through the top of the box, unexpectedly cannot be seen through the opening. The box is foldable and configurable by a child for entertainment and enjoyment.

24 Claims, 7 Drawing Sheets

MIRRORED BOX

FIELD OF THE INVENTION

The present invention relates to foldable boxes and, more particularly, to a foldable box with a hidden compartment and optical illusion.

BACKGROUND

Generally, boxes for creating an optical illusion and for concealing an object are known in the art. These prior art boxes are constructed of rigid materials such as wood, plastic or metal and include an interior compartment divided by a transversely disposed mirror to divide the compartment into a viewable compartment and a hidden compartment. The mirror, when viewed through an opening in the front of the box creates an optical illusion of a complete view of the interior of the box. An object placed in the hidden compartment is concealed from the viewer until it is desired to produce the object.

A problem with these devices is that they are rigid, and relatively costly to produce. It is desired to present a promotional device from a single sheet of cardboard that can be folded to a desired configuration of a box with a hidden compartment and optical illusion. It is particularly desirable for the folding may be accomplished by young children.

SUMMARY

In an embodiment of a box with a hidden compartment of the present invention is provided by a cardboard-like sheet of semi-rigid material presenting a bottom panel, a left inner side panel, a right inner side panel, a mirror panel, a front panel, a top panel, a left outer side panel, a right outer side panel, a back panel and an inner backer panel. The panels are connected to various other panels which when folded present a box with a compartment that is divided into a front compartment and a hidden compartment. The front compartment is viewable through an opening in the front of the box. A mirrored panel viewable through the opening creates an illusion of depth. An object placed in the hidden compartment through the top of the box, unexpectedly cannot be seen through the opening. The box is foldable and configurable by a child for entertainment and enjoyment.

Other advantages of this box assembly will become apparent from the following description taken in connection with the accompanying drawings, wherein is set forth by way of illustration and example an embodiment of the present invention.

BRIEF DESCRIPTIONS OF THE DRAWINGS

DETAILED DESCRIPTION

Figure 1:
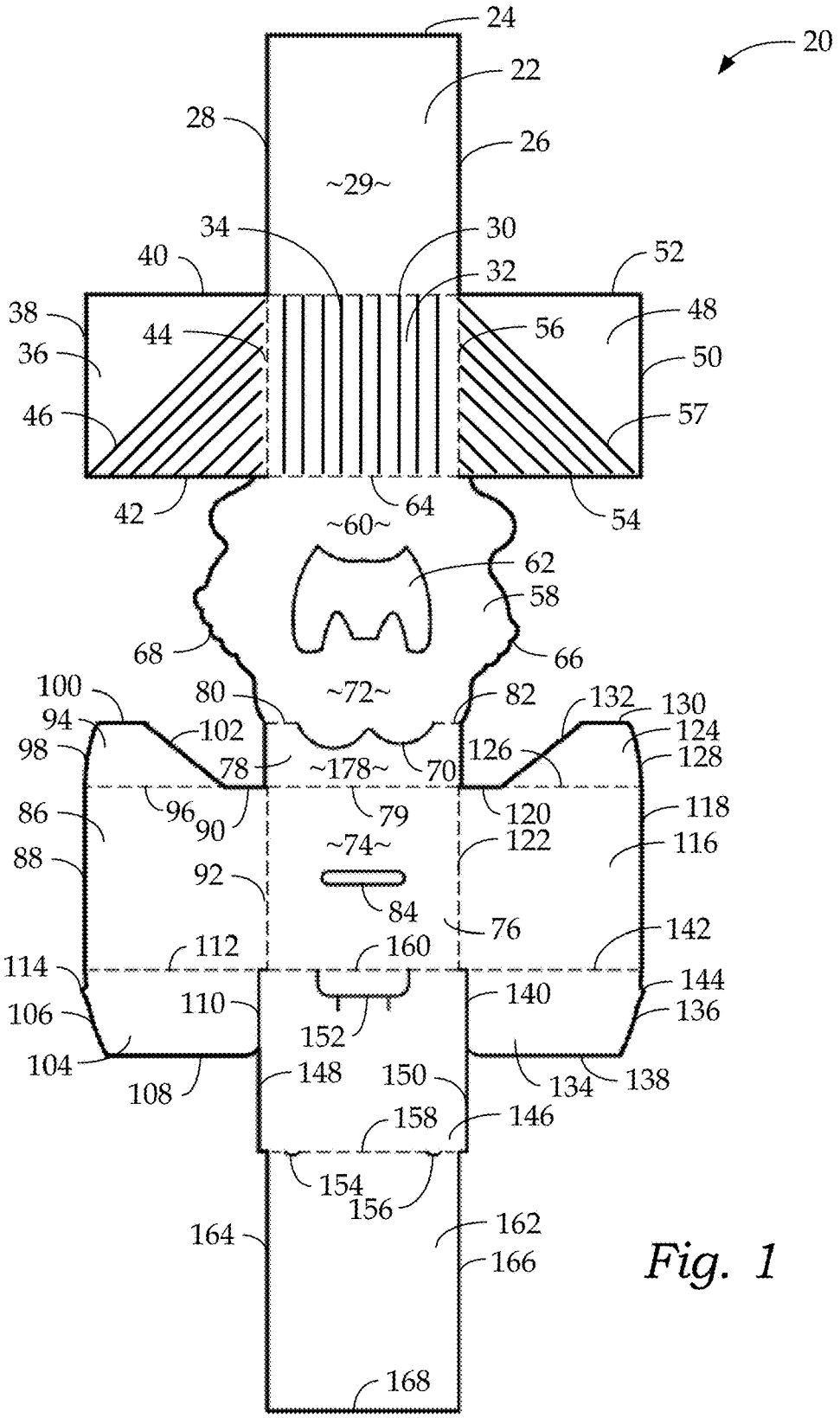
FIG. 1 is a flat unfolded plan view of the box of the present invention.

Referring initially to FIG. 1, an unfolded box of the present invention is generally indicated by reference numeral 20. Unfolded box 20 may be constructed of a heavy paper or card stock for example, and die cut to the shape shown in FIG. 1. The unfolded box 20 may include a plurality of panels connected along fold lines. A mirror panel 22 includes a front edge 24, side edges 26 and 28, and a reflective surface 29. The Mirror panel 22 is connected along fold line 30 to a bottom panel 32. Bottom panel 32 may include indicia 34 such as lines or stripes, for example, to create an illusion of depth, described in further detail herein below. A left inner side panel 36 includes a top edge 38, and side edges 40 and 42, and is connected along fold line 44 to the bottom panel 32. The left inner side panel 36 may include indicia 46 having a pattern matching the pattern of indicia 34 of the bottom panel 32. A right inner side panel 48 includes a top edge 50, side edges 52 and 54, and is connected along fold line 56 to the bottom panel 32. The right inner side panel 48 may include indicia 57 having a pattern matching the pattern of indicia 34 of the bottom panel 32.

A front panel 58 includes an interior surface 60 and an aperture 62, and is connected along fold line 64 to the bottom panel 32. As illustrated in FIG. 1 and the other figures, the front panel 58 is shaped like an animal character such as a lion character and the aperture 62 is shaped like an open mouth of the character. The shape of the front panel 58 is for illustrative purposes only and is not limited to the shape shown. Other character shapes, geometric shapes, and designs may be used as desired and are within the scope of this invention. The front panel 58 includes side edges 66 and 68, and may include a top edge 70. The front panel 58 may include an upper portion 72 that extends above a top surface 74 of a top panel 76 when the unfolded box 20 is folded, as described in detail herein below. A support panel 78 is connected along fold lines 80 and 82 to the upper portion 72 of front panel 58. The top panel 76 includes an aperture 84 for receiving objects such as coins, example, and is connected to the support panel 78 along fold line 79.

A left outer side panel 86 includes a bottom edge 88 and a front side edge 90, and is connected to the top panel 76 along fold line 92. A left front side tab 94 is connected along fold line 96 to the left outer side panel 86. The left front side tab 94 includes a bottom edge 98, a side edge 100, and a top edge 102. The bottom edge 98 may be slightly curved extending from the bottom edge 88 of the left outer side panel 86 to the side edge 100 of the left front side tab 94 to aid in assembly. The top edge 102 of the left front side tab 94 may extend at an angle from the side edge 100 of the left front side tab 94 to the front side edge 90 of the left outer side panel 86 so that the left rear side tab 94 does not obstruct the aperture 62 in the front panel 58. A left rear side tab 104 includes a bottom edge 106, a side edge 108, and a top edge 110. The left rear side tab 104 is connected along a fold line 112 to the left outer side panel 86. The bottom edge 106 of the left rear side tab 104 may be slightly curved extending from the bottom edge 88 of the left outer side panel 86 to the side edge 108 of the left rear side tab 104. The bottom edge 106 may include a locking tab 114.

A right outer side panel 116 includes a bottom edge 118 and a front side edge 120, and is connected to the top panel 76 along fold line 122. A right front side tab 124 is connected along fold line 126 to the right outer side panel 116. The right front side tab 124 includes a bottom edge 128, a side edge 130, and a top edge 132. The bottom edge 128 may be slightly curved extending from the bottom edge 118 of the right outer side panel 116 to the side edge 130 of the right front side tab 124 to aid in assembly. The top edge 132 of the right front side tab 124 may extend at an angle from the side edge 130 of the right front side tab 124 to the front side edge 120 of the right outer side panel 116 so that the right front side tab 124 does not obstruct the aperture 62 in the front panel 58. A right rear side tab 134 includes a bottom edge 136, a side edge 138, and a top edge 140. The right front side tab 134 is connected along a fold line 142 to the right outer side panel 116. The bottom edge 136 of the right rear side tab 134 may be slightly curved extending from the bottom edge 118 of the right outer side panel 116 to the side edge 138 of the right from side tab 134. The bottom edge 136 may include a locking tab 144.

A back panel 146 includes side edges 148 and 150, and an object removal cutout 152, and a left locking notch 154 and a right locking notch 156 along fold line 158. The back panel 146 and object removal cutout 152 are connected along a fold line 160 to top panel 76.

An inner backer panel 162 includes side edges 164 and 166, and a top edge 168. The inner backer panel 162 is connected along fold line 158 to the back panel 146. The back panel 146 may be slightly wider than the top panel 76 and the inner backer panel 162.

Figure 2:
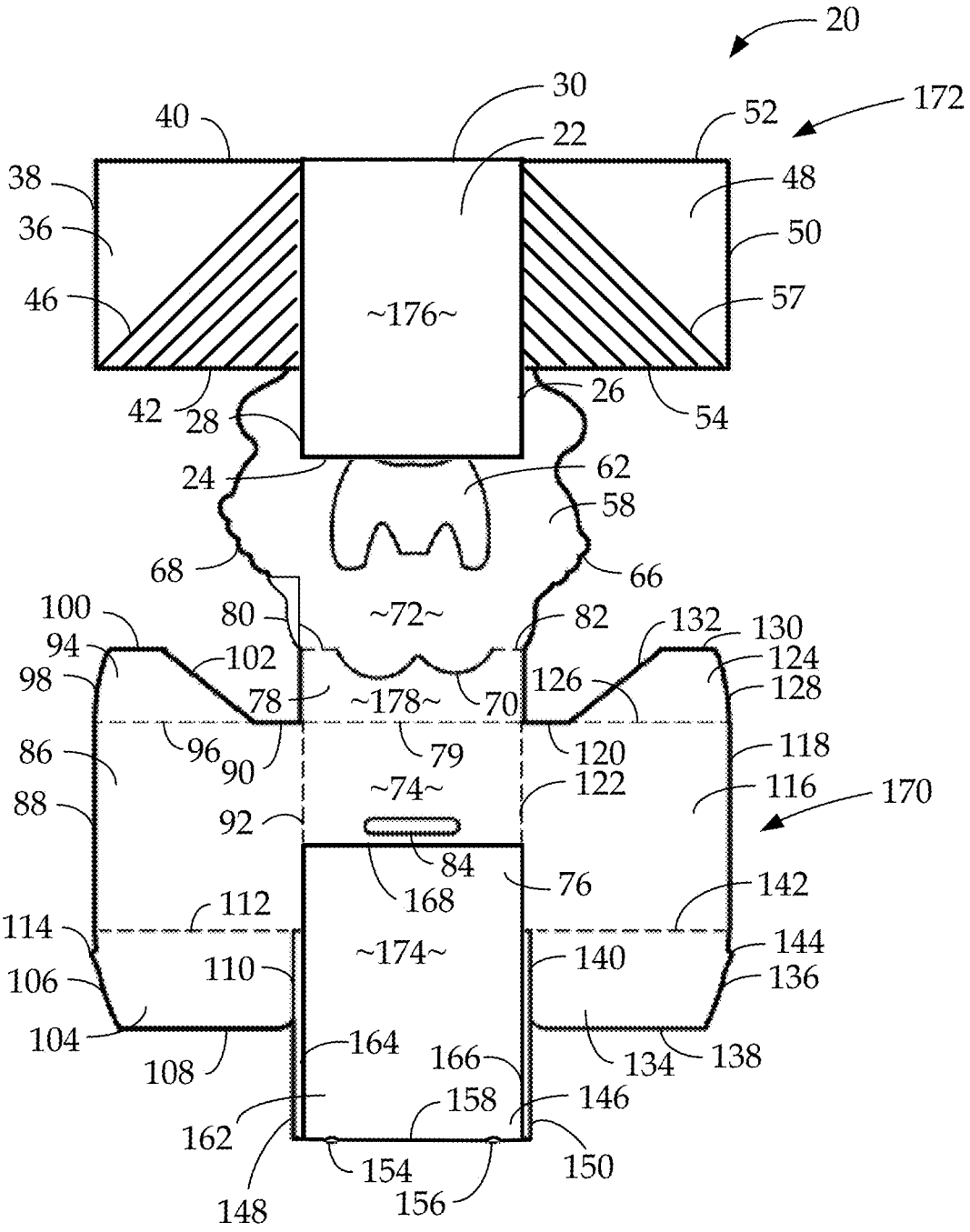
FIG. 2 is a partially folded plan view of the box of FIG. 1.

Referring to FIGS. 1 and 2, the initial panel folds are illustrated. The mirror panel 22 is folded along fold line 30 flat over bottom panel 32 a portion of front panel 58. The inner backer panel 162 is folded along fold line 158 over back panel 146 and a portion of top panel 76.

Figure 3:
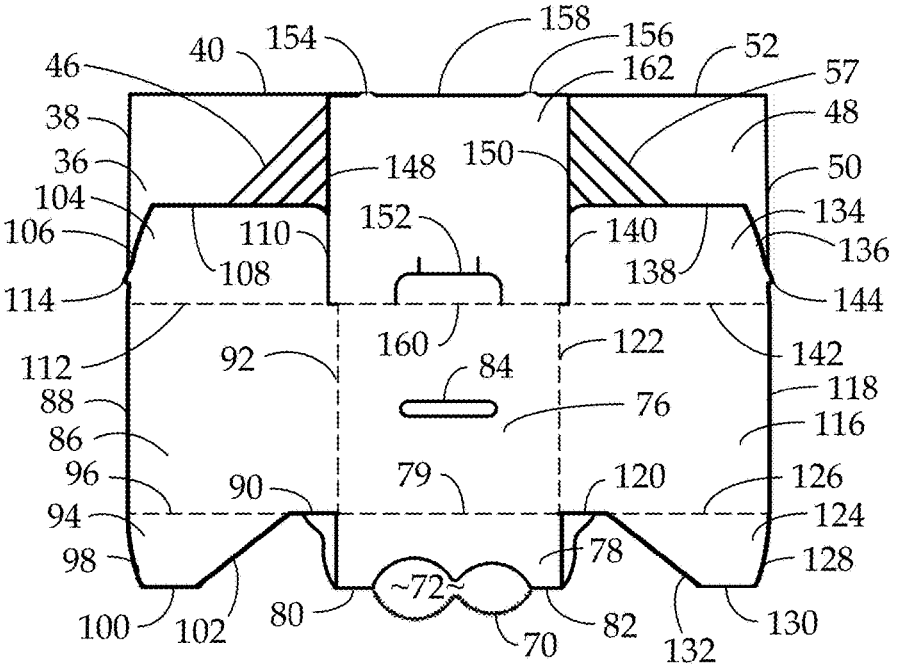
FIG. 3 is a continued folded plan view of the box of FIG. 2.
Figure 4:
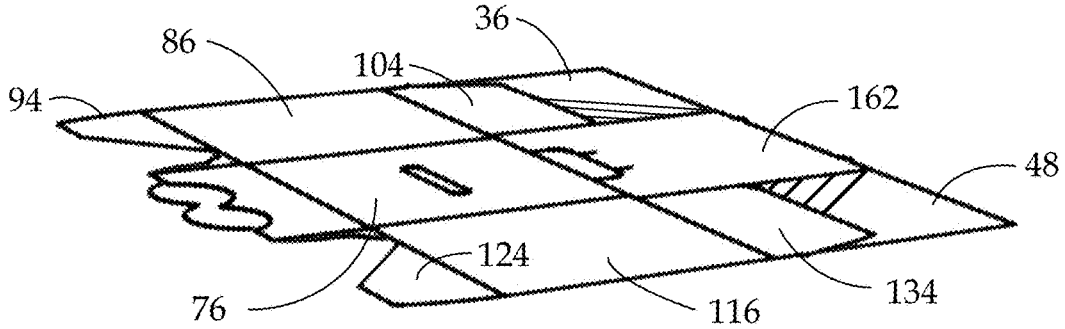
FIG. 4 is a perspective view of the box of FIG. 3.
Figure 5:
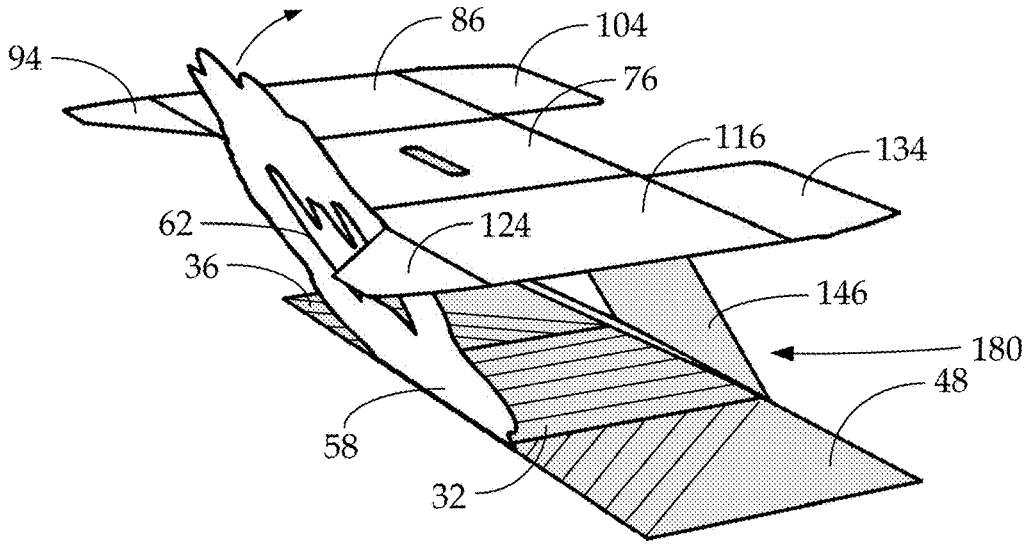
FIG. 5 is a perspective view of the box of FIG. 4 partially assembled.
Figure 6:
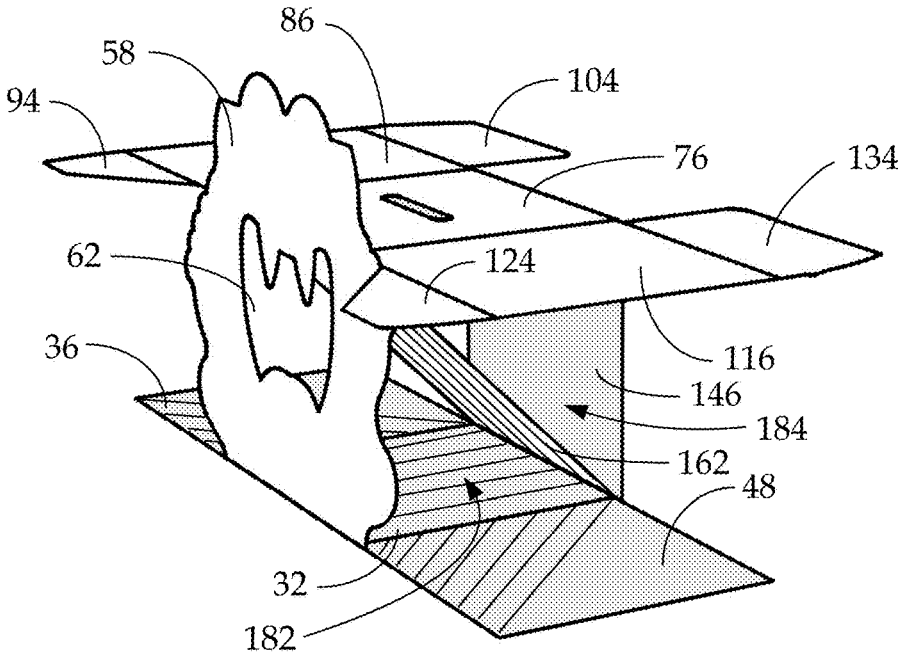
FIG. 6 is a perspective view of the box of FIG. 5 in an open box configuration.
Figure 7:
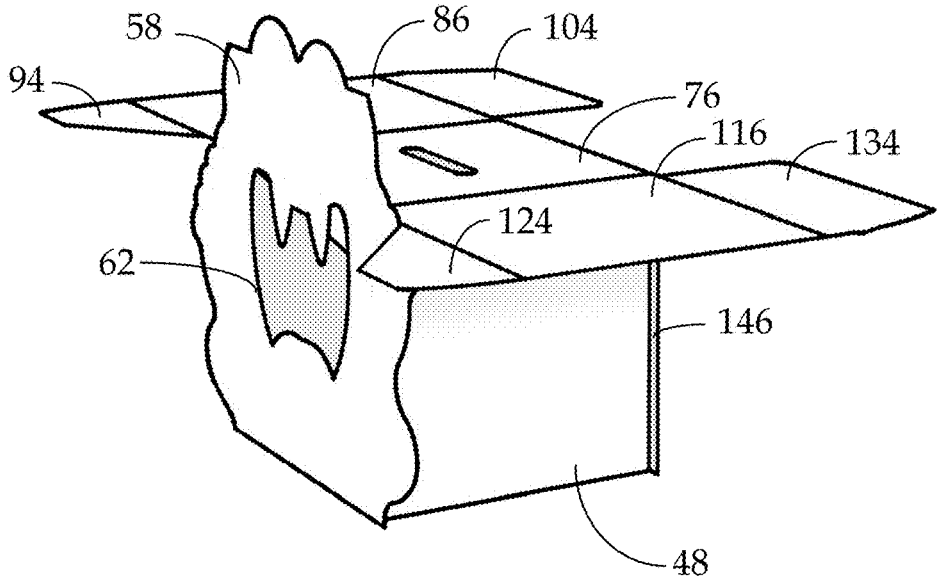
FIG. 7 is a perspective view of the box of FIG. 6 with the lower side panels folded to enclose the interior of the box.
Figure 8:
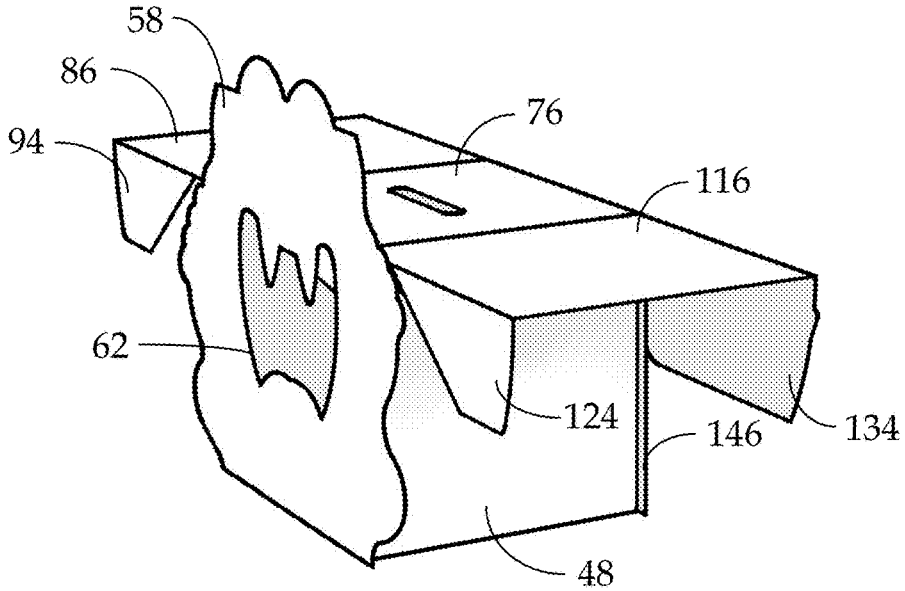
FIG. 8 is a perspective view of the box of FIG. 7 with the tabs of the upper side panels folded downwardly.
Figure 9:
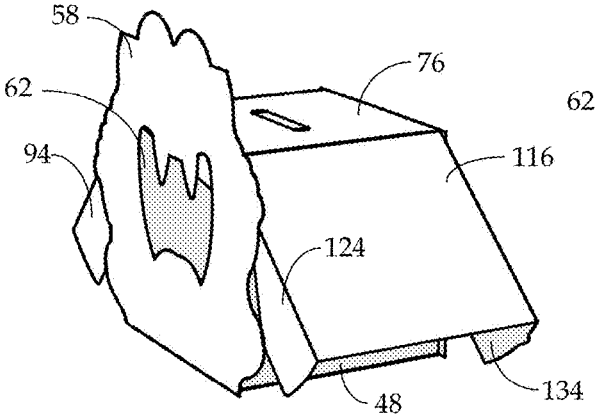
FIG. 9 is a perspective view of the box of FIG. 8 with the upper side panels partially folded downwardly.
Figure 10:
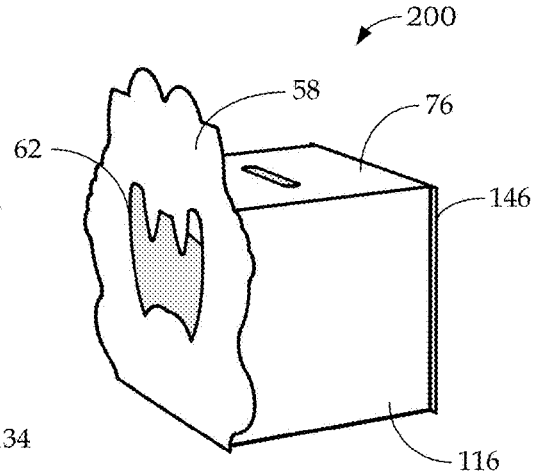
FIG. 10 is a perspective view of the box of FIG. 9 with the upper side panels folded downwardly and the folded box of the present invention completed.
Figure 11:
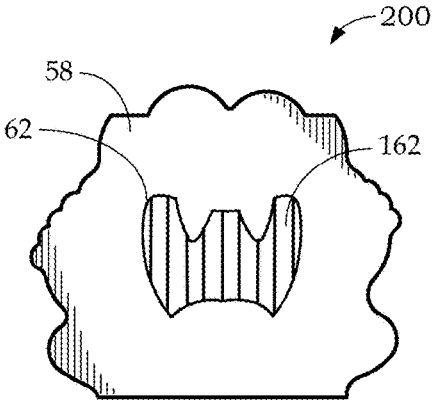
FIG. 11 is a front elevational view of the box of FIG. 10.
Figure 12:
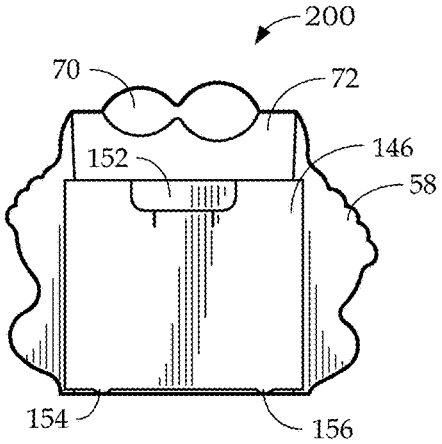
FIG. 12 is a rear elevational view of the box of FIG. 10.
Figure 13:
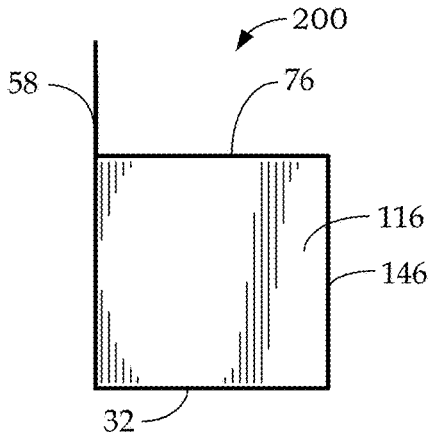
FIG. 13 is a side view elevational view of the box of FIG. 10.
Figure 14:
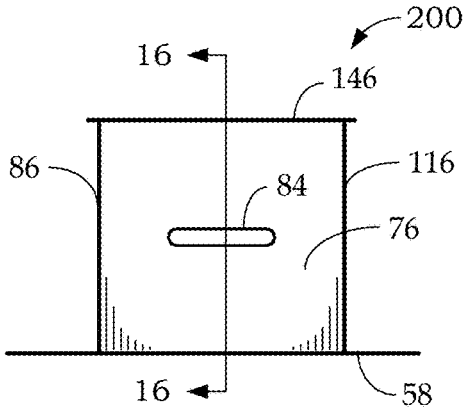
FIG. 14 is a top view of the box of FIG. 10.
Figure 15:
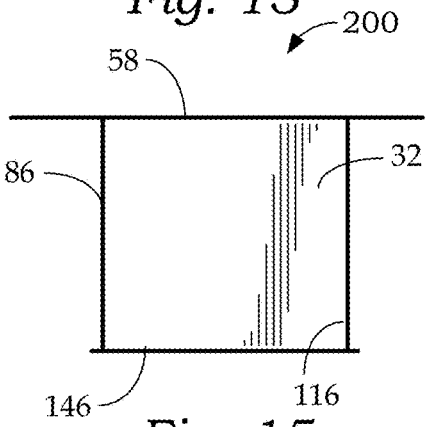
FIG. 15 is a bottom view of the box of FIG. 10.
Figure 16:
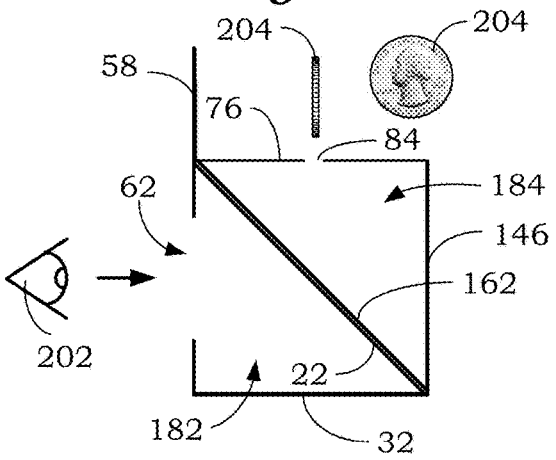
FIG. 16 is a cross-sectional view of the box of FIG. 14 along line 16-16.
Figure 17:
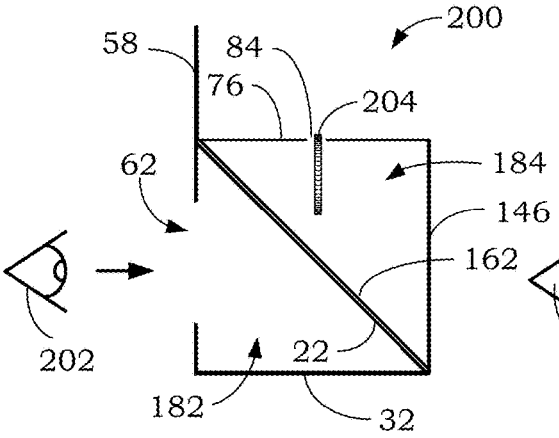
FIG. 17 is the box of FIG. 16 shown with a coin inserted in an upper slot.
Figure 18:
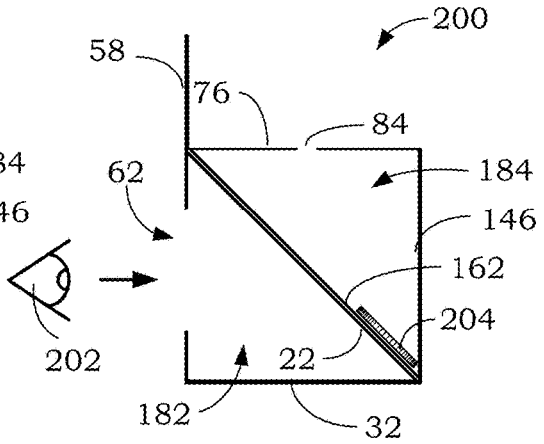
FIG. 18 is the box of FIG. 16 shown with the coin resting in a hidden compartment.

Referring to FIGS. 1-3, a lower portion of the unfolded box 20, generally indicated by reference numeral 170, is folded over an upper portion of the unfolded box 20, generally indicated by reference numeral 172, along fold lines 80 and 82. A back surface 174 of inner backer panel 162 is aligned with and may be glued or otherwise fastened to a back surface 176 of the mirror panel 22 to provide rigidity to the combination. Additionally, a surface 178 of support panel 78 may be glued or otherwise fastened to the upper portion 72 of front panel 58.

Referring to FIGS. 5-15, as the upper portion 72 of the front panel 58 is lifted up, the front panel 58 is pivoted about fold lines 80 and 82 with respect to top panel 76, and fold line 64 with respect to bottom panel 32. At the same time, top panel 76 pivots about fold line 160 with respect to back panel 146. Likewise, back panel 146 pivots about fold line 158 of inner backer panel 162, and the mirror panel 22 pivots about fold line 30 with respect to bottom panel 32. As the front panel 58 is lifted up the mirror panel 22 with the inner backer panel 162 are forced to slide upwardly along the inner surface 60 of the front panel 58 toward the fold line 79. Once the panels are at right angles relative to the adjacent panels, the front edge 24 of the mirror panel 22 and the top edge 168 of the inner backer panel 162 are in contact with or proximal fold line 79 in a corner formed at the intersection of the front panel 58 and the top panel 76, extending diagonally across a compartment 180 formed by the panels at an angle of approximately 45 degrees, and dividing the compartment 180 into a front compartment 182 and a hidden compartment 184.

Next, the right inner side panel 48 is folded upwardly along fold line 56, and the left inner side panel 36 is folded upwardly along fold line 44 (not shown), to enclose the compartment 178. The left front side tab 94 is folded downwardly along fold line 96 generally to a right angle relative to the left outer side panel 86. The left rear side panel 104 is folded downwardly along fold line 112 generally to a right angle relative to the left outer side panel 86. The right front side tab 124 is folded downwardly along fold line 126 generally to a right angle relative to the right outer side panel 116. The right rear side tab 134 is folded downwardly along fold line 142 generally to a right angle relative to the right outer side panel 116. The left outer side panel 86 is then folded downwardly along fold line 92, and the left front side tab 94 is tucked into the seam between the front panel 58 and the side edge 42 of the left inner side panel 36. The left rear side tab 104 is tucked into the seam between the front panel 58 and the side edge 40 of the left inner side panel 36. The left outer side panel 86 is folded until it is generally at a right angle relative to top panel 76 and the locking tab 114 of the left rear side panel 104 is received in left locking notch 154. The right outer side panel 116 is then folded downwardly along fold line 122, and the right front side tab 124 is tucked into the seam between the front panel 58 and the side edge 54 of the right inner side panel 48. The right outer side panel 116 is folded until it is generally at a right angle relative to the top panel 76, and the locking tab 144 of the right rear side panel 134 is received in the right locking notch 156. The fully assembled box is generally indicated by reference numeral 200.

Referring to FIGS. 11-18, the illusion of the box is illustrated. When viewed from the front of the box (see FIG. 11), the front compartment 182 appears to extend to the back of the box 200 because the indicia 34 on the interior bottom panel 32 is reflected by the reflective surface 29 of mirror panel 22. Because the mirror panel 22 is arranged at a 45 degree angle to the interior bottom panel 32 and is in alignment with the indicia 46 of the left inner side panel 36 and the indicia 57 of the right inner side panel 48, an optical illusion of depth is presented to the eye 202 of an observer looking through the front opening or aperture 62 of the front panel 58.

When a coin 204, such as a quarter, or other object is inserted through the slot 84 in top panel 76, the observer may expect to see the coin 204 appear in the front compartment 182. However, because of the arrangement of the mirror panel 22 and the inner backer panel 162, the coin 204 falls into the hidden compartment 184 to the surprise of the observer. The observer may shake the box 200 to verify that the coin 204 is indeed in the box 200, but because of the optical illusion of the arrangement of the mirror panel 22 and the indicia 34, 46 and 57, the observer is further astonished and amazed that the coin 204 cannot be seen through the front opening or aperture 62 of the front panel 58. Upon close examination, an observer may discover that the mirror panel 22 is not the back inner surface of the box 200, but a mirror presenting the optical illusion.

It is to be understood that while certain forms of this invention have been illustrated and described, it is not limited thereto, except insofar as such limitations are included in the following claims.

The invention claimed is:

1. A foldable box with a hidden compartment and optical illusion, said foldable box comprising:

a sheet of semi-rigid material presenting a bottom panel, a left inner side panel, a right inner side panel, a mirror panel, a front panel, a top panel, a left outer side panel, a right outer side panel, and a back panel;

said left inner side panel connected to said bottom panel along a first fold line;

said right inner side panel connected to said bottom panel along a second fold line opposite said first fold line;

said mirror panel having a reflective surface and connected to said bottom panel along a third fold line;

said front panel having an aperture and connected to said bottom panel along a fourth fold line opposite said third fold line;

said top panel having an aperture and connected to said front panel along a fifth fold line opposite said fourth fold line;

said left outer side panel connected to said top panel along a sixth fold line;

said right outer side panel connected to said top panel along a seventh fold line opposite said sixth fold line;

said back panel connected to said top panel along an eighth fold line opposite said fifth fold line;

wherein said mirror panel is folded along said third fold line flat against said bottom panel;

wherein said top panel is folded along said fifth fold line flat against said front panel;

wherein simultaneously said back panel is folded along said eighth fold line to a right angle to said top panel, said top panel is folded along said fifth fold line to a right angle to said front panel, said front panel is folded along said fourth panel to a right angle to said bottom panel, and said mirror panel is folded along said third fold line to a 45-degree angle to said bottom panel dividing an interior compartment of said foldable box into a front compartment and a hidden compartment;

wherein said left and right inner side panels are folded upwardly from said bottom panel along said first and second fold lines respectively to a right angle to form interior sides of said foldable box; and wherein said left and right outer panels are folded downwardly from said top panel along said sixth and seventh fold lines respectively to a right angle over said left and right interior side panels to enclose said foldable box.

2. The foldable box of claim 1 wherein said reflective surface of said mirror panel is viewable through said aperture of said front panel.

3. The foldable box of claim 2 wherein said reflective surface of said mirror panel reflects a surface of said bottom panel.

4. The foldable box of claim 3 wherein said surface of said bottom panel included includes indicia.

5. The foldable box of claim 4 wherein said first and second side panels each have a surface with indicia having a pattern matching said indicia of said bottom panel.

6. The foldable box of claim 5 wherein said bottom panel indicia and said first and second side panel indicia present an illusion of depth.

7. The foldable box of claim 1 wherein said front compartment is viewable through said aperture of said front panel.

8. The foldable box of claim 1 wherein said aperture of said top panel is in communication with said hidden compartment.

9. A foldable box with a hidden compartment and optical illusion, said foldable box comprising:

a sheet of semi-rigid material presenting a bottom panel, a left inner side panel, a right inner side panel, a mirror panel, a front panel, a top panel, a left outer side panel, a right outer side panel, a back panel and an inner backer panel;

said left inner side panel connected to said bottom panel along a first fold line;

said right inner side panel connected to said bottom panel along a second fold line opposite said first fold line;

said mirror panel having a reflective surface and connected to said bottom panel along a third fold line;

said front panel having an aperture and connected to said bottom panel along a fourth fold line opposite said third fold line;

said top panel having an aperture and connected to said front panel along a fifth fold line opposite said fourth fold line;

said left outer side panel connected to said top panel along a sixth fold line;

said right outer side panel connected to said top panel along a seventh fold line opposite said sixth fold line;

said back panel connected to said top panel along an eighth fold line opposite said fifth fold line;

said inner backer panel connected to said back panel along a ninth fold line opposite said eighth fold line;

wherein said mirror panel is folded along said third fold line flat against said bottom panel;

wherein said inner backer panel is folded along said ninth fold line flat against said back panel;

wherein said top panel is folded along said fifth fold line flat against said front panel and wherein a first surface of said mirror panel opposite said reflective surface is bonded to a second surface of said backer panel;

wherein simultaneously said back panel is folded along said eighth fold line to a right angle to said top panel, said top panel is folded along said fifth fold line to a right angle to said front panel, said front panel is folded along said fourth panel to a right angle to said bottom panel, said inner backer panel is folded along said ninth fold line to a 45-degree angle to said back panel, and said mirror panel is folded along said third fold line to a 45-degree angle to said bottom panel dividing an interior compartment of said foldable box into a front compartment and a hidden compartment;

wherein said left and right inner side panels are folded upwardly from said bottom panel along said first and second fold lines respectively to a right angle to form interior sides of said foldable box; and wherein said left and right outer panels are folded downwardly from said top panel along said sixth and seventh fold lines respectively to a right angle over said left and right interior side panels to enclose said foldable box.

10. The foldable box of claim 9 wherein said reflective surface of said mirror panel is viewable through said aperture of said front panel.

11. The foldable box of claim 10 wherein said reflective surface of said mirror panel reflects a surface of said bottom panel.

12. The foldable box of claim 11 wherein said surface of said bottom panel includes indicia.

13. The foldable box of claim 12 wherein said first and second side panels each have a surface with indicia having a pattern matching said indicia of said bottom panel.

14. The foldable box of claim 13 wherein said bottom panel indicia and said first and second side panel indicia present an illusion of depth.

15. The foldable box of claim 9 wherein said front compartment is viewable through said aperture of said front panel.

16. The foldable box of claim 9 wherein said aperture of said top panel is in communication with said hidden compartment.

17. A method of creating a box with a hidden compartment and optical illusion, said method comprising:

a sheet of semi-rigid material presenting a bottom panel, a left inner side panel, a right inner side panel, a mirror panel, a front panel, a top panel, a left outer side panel, a right outer side panel, and a back panel;

said left inner side panel connected to said bottom panel along a first fold line;

said right inner side panel connected to said bottom panel along a second fold line opposite said first fold line;

said mirror panel having a reflective surface and connected to said bottom panel along a third fold line;

said front panel having an aperture and connected to said bottom panel along a fourth fold line opposite said third fold line;

said top panel having an aperture and connected to said front panel along a fifth fold line opposite said fourth fold line;

said left outer side panel connected to said top panel along a sixth fold line;

said right outer side panel connected to said top panel along a seventh fold line opposite said sixth fold line;

said back panel connected to said top panel along an eighth fold line opposite said fifth fold line;

folding said mirror panel along said third fold line flat against said bottom panel;

folding said top panel along said fifth fold line flat against said front panel;

simultaneously folding said back panel along said eighth fold line to a right angle to said top panel, said top panel along said fifth fold line to a right angle to said front panel, said front panel along said fourth panel to a right angle to said bottom panel, and said mirror panel along said third fold line to a 45-degree angle to said bottom panel dividing an interior compartment of said foldable box into a front compartment and a hidden compartment;

folding said left and right inner side panels upwardly from said bottom panel along said first and second fold lines respectively to a right angle to form interior sides of said foldable box; and folding said left and right outer panels downwardly from said top panel along said sixth and seventh fold lines respectively to a right angle over said left and right interior side panels to enclose said foldable box.

18. The method of claim 17 wherein said reflective surface of said mirror panel is viewable through said aperture of said front panel.

19. The method of claim 18 wherein said reflective surface of said mirror panel reflects a surface of said bottom panel.

20. The method of claim 19 wherein said surface of said bottom panel includes indicia.

21. The method of claim 20 wherein said first and second side panels each have a surface with indicia having a pattern matching said indicia of said bottom panel.

22. The method of claim 21 wherein said bottom panel indicia and said first and second side panel indicia present an illusion of depth.

23. The method of claim 17 wherein said front compartment is viewable through said aperture of said front panel.

24. The method of claim 17 wherein said aperture of said top panel is in communication with said hidden compartment.

* * * * *